US006170726B1

(12) United States Patent
Jensen

(10) Patent No.: US 6,170,726 B1
(45) Date of Patent: Jan. 9, 2001

(54) DISPENSER ROLLER PROVIDING EXTENDED MATERIAL END

(76) Inventor: Lars D. Jensen, 6604 Cliffwood Ct., Arlington, TX (US) 76016

( * ) Notice: Under 35 U.S.C. 154(b), the term of this patent shall be extended for 0 days.

(21) Appl. No.: 09/206,324

(22) Filed: Dec. 8, 1998

(51) Int. Cl.[7] ..... B26F 3/02

(52) U.S. Cl. ..... 225/12; 225/23; 225/77; 225/96.5

(58) Field of Search ..... 225/12, 23, 77, 225/96.5

(56) References Cited

U.S. PATENT DOCUMENTS

| | | | | |
|---|---|---|---|---|
| 1,094,765 | | 4/1914 | Weeks . | |
| 1,261,668 | | 4/1918 | Winterhalter . | |
| 1,299,087 | | 4/1919 | Winterhalter . | |
| 2,274,623 | | 2/1942 | Hawkins . | |
| 2,305,592 | * | 12/1942 | Anderson | 225/12 |
| 2,434,776 | | 1/1948 | Van Cleef et al. . | |
| 2,522,047 | | 9/1950 | Krueger et al. . | |
| 2,553,658 | | 5/1951 | Larson . | |
| 2,555,187 | | 5/1951 | Erhardt . | |
| 2,573,912 | | 11/1951 | Krueger . | |
| 2,574,175 | | 11/1951 | Erhardt . | |
| 2,582,705 | | 1/1952 | Krueger . | |
| 2,590,549 | | 3/1952 | Krueger et al. . | |
| 2,599,750 | | 6/1952 | Erhardt . | |
| 2,625,744 | * | 1/1953 | Wilkin | 225/12 |
| 2,663,369 | | 12/1953 | Erhardt . | |
| 2,693,988 | * | 11/1954 | Switzer | 225/12 |
| 3,273,772 | | 9/1966 | Nakajima et al. . | |
| 3,466,215 | * | 9/1969 | Krueger | 225/12 |
| 3,628,710 | * | 12/1971 | Mannheim et al. | 225/96.5 |
| 4,372,472 | | 2/1983 | Herrmann . | |
| 4,586,639 | | 5/1986 | Ruff et al. . | |
| 4,608,894 | | 9/1986 | Lee et al. . | |
| 4,752,023 | | 6/1988 | Lin . | |
| 4,787,542 | | 11/1988 | Ruff et al. . | |
| 4,856,397 | | 8/1989 | Rebekale . | |
| 4,996,901 | | 3/1991 | Fullerton . | |
| 5,167,357 | | 12/1992 | Shih . | |
| 5,381,942 | * | 1/1995 | Lin | 225/77 |

* cited by examiner

*Primary Examiner*—M. Rachuba
(74) *Attorney, Agent, or Firm*—Lars D. Jensen

(57) ABSTRACT

A manual dispenser of material of indeterminate length, which is engaged on a rotating roller assembly, such that when the end of the material is pulled, the roller rotates with the material until reaching a stop, whereafter by slipping, additional material is advanced a length suitable to the user. The material is then forced to sever against a cutter, creating a useful material segment, and also releasing the roller assembly to rotate backwards, powered by a biasing spring. Upon return, the roller holds the remnant end of the material extended, readily accessible for grasping. An alternate embodiment comprises a movable cutter.

14 Claims, 10 Drawing Sheets

DISPENSER ROLLER PROVIDING EXTENDED MATERIAL END

CROSS REFERENCE

This application is also related to application serial 09/207,533 filed on even date herewith, entitled "Dispenser Feeder Providing Extended Material End," by inventor Lars D. Jensen. Which application is not admitted to be prior art by its mention as this reference.

BACKGROUND

Materials of indeterminate length fall into two general categories: a) web-like shapes, such as paper, aluminum foil, and tape; and b) filament-like shapes, such as string, wire, and tubing. Web dispensers must be designed to overcome common problems such as handling and cutting across wide material. Filament dispensers may have common problems such as controlling twisting and backlash. However, every dispenser (regardless of type of material) must provide some kind of feeding action. The feeding action is that way of advancing new material and controlling the cut end (which remains after the previously dispensed segment has been removed.) The cut end must be "retained" so as not to become loose or hard to find. It is also preferable that the cut end be at a "convenient position," having moved away from the cutter (or whose cutter has been moved away.) Finally, an ideal feeder would provide an extended end of material, ready to simply grasp and pull.

Using a common dispenser of prior art, where a material is cut manually by forcing it against a sharp edge, the user leaves with the segment. The user has no further involvement with the dispenser, so the cut end typically stays near the cutter.

Some inventions of prior art have included additional mechanisms to advance the material. Sometimes, this is done by pushing a button or pulling a lever. This is not desirable, since it requires an extra step, making an extra effort. Other prior art dispensers advance the material automatically, using a motor or air cylinder. Some dispensers also cut automatically. While convenient, these automatic dispensers are complicated and not as affordable as manual dispensers.

In a few prior art dispenser designs, the user first pulls the desired length of material, and then uses the lateral cutting movement to activate some mechanism. However, none of these has been entirely satisfactory, the proof of which is that they have not become popularly used. Accordingly, there is a need for an inexpensive manually powered dispenser with that provides an extended material end for easy grasping.

SUMMARY OF THE INVENTION

It is an object of the present invention to provide a device which dispenses material of indeterminate length which presents to the user an extended material end (which is the remnant from a previously dispensed segment.) This objective is achieved by the present invention in two ways. First, by having a rotating roller which reverses rotation after the cut is made, leaving the end exposed in a cantilever manner. Secondly, by having a rotating roller and a movable cutter, both of which move after the cut, to positions which make the extended material end readily accessible.

A second object of the present invention is to provide a dispenser which is manually-powered. This objective is achieved by storing energy from the act of advancing the material while rotating the roller, and by using the act of cutting to release that energy to reverse the rotation of the roller.

A third objective of the present invention is to provide a dispenser which is affordable for typical home and office use. This objective is achieved by a simple design, having few moving parts, most of which can be fabricated inexpensively using the plastic injection molding process.

The following illustrations and descriptions will disclose an entirely new dispensing action. Dispensers of prior art have actions where the user first pulls the material longitudinally to a desired length. Secondly, the user moves the material laterally (on the way to the cutter) against some "push away" or "triggering" device. By contrast, the present invention acts first to rotate and store energy in a roller during the longitudinal movement. Then, the material is allowed to slip, to advance a length of material as desired. After cutting, the roller reverses to provide an easily accessible extended material end. These and other features, aspects, and advantages will become better understood with regard to the following drawings, description, and appended claims.

Figure 1:
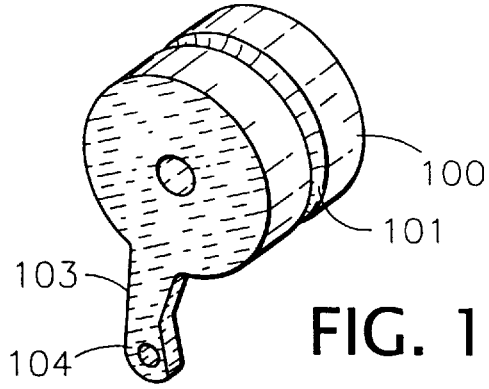
FIG. 1 is a perspective view of a grooved roller.

| REFERENCE NUMERALS USED IN THE DRAWINGS | |
|---|---|
| 100 | grooved roller |
| 101 | groove |
| 102 | shaft |
| 103 | arm |
| 104 | spring mount |
| 105 | spring anchor |
| 106 | spring |
| 107 | cut out edge |
| 108 | wheel |
| 109 | shaft |
| 110 | arm |
| 111 | spring mount |
| 112 | pin |
| 113 | spring |
| 114 | spring anchor |
| 115 | stop |
| 150 | base |
| 151 | supply of material |
| 152 | drawn piece of material |
| 153 | slack shape |
| 154 | straight shape |
| 155 | extended material end |
| 155 | new extended material end |
| 156 | segment of material |
| 157 | cutter |
| 158 | screw |
| 159 | side guard |
| 160 | initial pull direction |
| 161 | continued pull direction |
| 162 | cutting direction |
| 163 | cut edge |
| 164 | sharp edge |
| 170 | self-engaging roller |
| 171 | deep groove |
| 200 | grooved roller |
| 200a | alternate grooved roller |
| 201 | ledge |
| 202 | shaft |
| 203 | arm |
| 205 | link |
| 206 | weight |
| 207 | link pin |
| 208 | wheel |
| 209 | shaft |
| 210 | arm |
| 211 | spring mount |
| 212 | pin |
| 213 | spring |
| 214 | spring anchor |
| 215 | stop |
| 220 | cutter |
| 221 | shaft |
| 222 | cutter arm |
| 223 | foot |
| 224 | floor stop |
| 250 | base |
| 251 | supply of material |
| 252 | extended piece of material |
| 253 | slack shape |
| 254 | straight shape |
| 255 | extended material end |
| 255a | extended material end |
| 255' | new extended material end |
| 256 | segment of material |
| 257 | cutter blade |
| 258 | screw |
| 259 | side guard |
| 260 | initial pull direction |
| 261 | continued pull direction |
| 262 | cutting direction |
| 263 | cut edge |
| 264 | sharp edge |
| 300 | roller assembly |
| 301 | outer roller |
| 302 | inner roller |
| 303 | arm |
| 304 | spring mount |

-continued

| REFERENCE NUMERALS USED IN THE DRAWINGS | |
|---|---|
| 305 | spring anchor |
| 306 | spring |
| 307 | cut out edge |
| 308 | left stop |
| 309 | right stop |
| 310 | shaft |
| 311 | keeper |
| 350 | base |
| 351 | roll of tape |
| 352 | drawn piece of tape |
| 353 | slack shape |
| 354 | straight shape |
| 355 | extended tape end |
| 355' | new extended tape end |
| 356 | segment of tape |
| 357 | cutter |
| 358 | screw |
| 359 | side guard |
| 360 | initial pull direction |
| 361 | continued pull direction |
| 362 | cutting direction |
| 363 | cut edge |
| 364 | sharp edge |
| 400 | roller assembly |
| 401 | outer roller |
| 402 | inner roller |
| 403 | arm |
| 404 | pin hole |
| 405 | link |
| 406 | weight |
| 407 | link pin |
| 408 | cambered surface |
| 410 | shaft |
| 420 | cutter |
| 421 | shaft |
| 422 | cutter arm |
| 423 | foot |
| 424 | floor stop |
| 425 | wall stop |
| 450 | base |
| 451 | roll of tape |
| 452 | drawn piece of tape |
| 453 | slack shape |
| 454 | straight shape |
| 455 | extended tape end |
| 455' | new extended tape end |
| 456 | segment of tape |
| 457 | cutter blade |
| 458 | screw |
| 459 | side guard |
| 460 | initial pull direction |
| 461 | continued pull direction |
| 462 | cutting direction |
| 463 | cut edge |
| 464 | sharp edge |
| 500 | roller assembly |
| 501 | outer roller |
| 502 | inner roller |
| 503 | axle |
| 504 | spring lug |
| 505 | spring anchor |
| 506 | spring |
| 507 | cut out edge |
| 508 | stop |
| 550 | base |
| 551 | roll of tape |
| 552 | drawn piece of tape |
| 553 | slack shape |
| 554 | straight shape |
| 555 | extended tape end |
| 555' | new extended tape end |
| 556 | segment of tape |
| 557 | cutter |
| 558 | screw |
| 559 | side guard |
| 560 | initial pull direction |
| 561 | continued pull direction |

-continued

| REFERENCE NUMERALS USED IN THE DRAWINGS | |
|---|---|
| 562 | cutting direction |
| 563 | cut edge |
| 564 | sharp edge |
| 565 | reversing rotation direction |

DETAILED DESCRIPTION OF THE INVENTION

An essential component of the present invention is a roller (such the one shown as reference numeral 100 in FIG. 1) which provides a path for material of indeterminate length. The material is "engaged" on the roller, although sometimes it "slips" on the roller. Therefore, it is instructive to first define these terms in detail.

In regard to the present invention, material can be "engaged" on the surface of a roller in two ways. Firstly, the material can be impressed against the roller by another component (like the spring-loaded wheel 108 of FIG. 2) The result is that the surface of the material is frictionally cohered with the surface of the roller. Secondly, a tape which has adhesive on at least one side can be "engaged" on a roller by simply adhering to the roller. It is possible to be continuously adhered to the roller, even while the material is moving tangentially and while the roller is rotating.

Once engaged, if one were to pull on the material, it would cause the roller to turn if it were free to do so. Or, if a roller (such as grooved roller 100 of FIG. 2) reverses (turns counterclockwise in this view) it moves the material (to the left in this view.) Therefore, if a material is engaged to the roller, then the material can move the roller, or the roller can move the material. If the material were not engaged, the loose end could become lost (or in the case of adhesive tape might re-stick to the roll.) After the cut, the material is engaged so as to provide an extended material end supported in a cantilever manner.

As will be explained in the first embodiment of the present invention, it is sometimes necessary for a material to slip on the roller. This simply means that the frictional cohesion is overcome by a pulling force so great that the material slides along the roller even while still in contact. In the special case of adhesive tape, which cannot slip, a second roller is provided which slips relative to a first roller.

Figure 2:
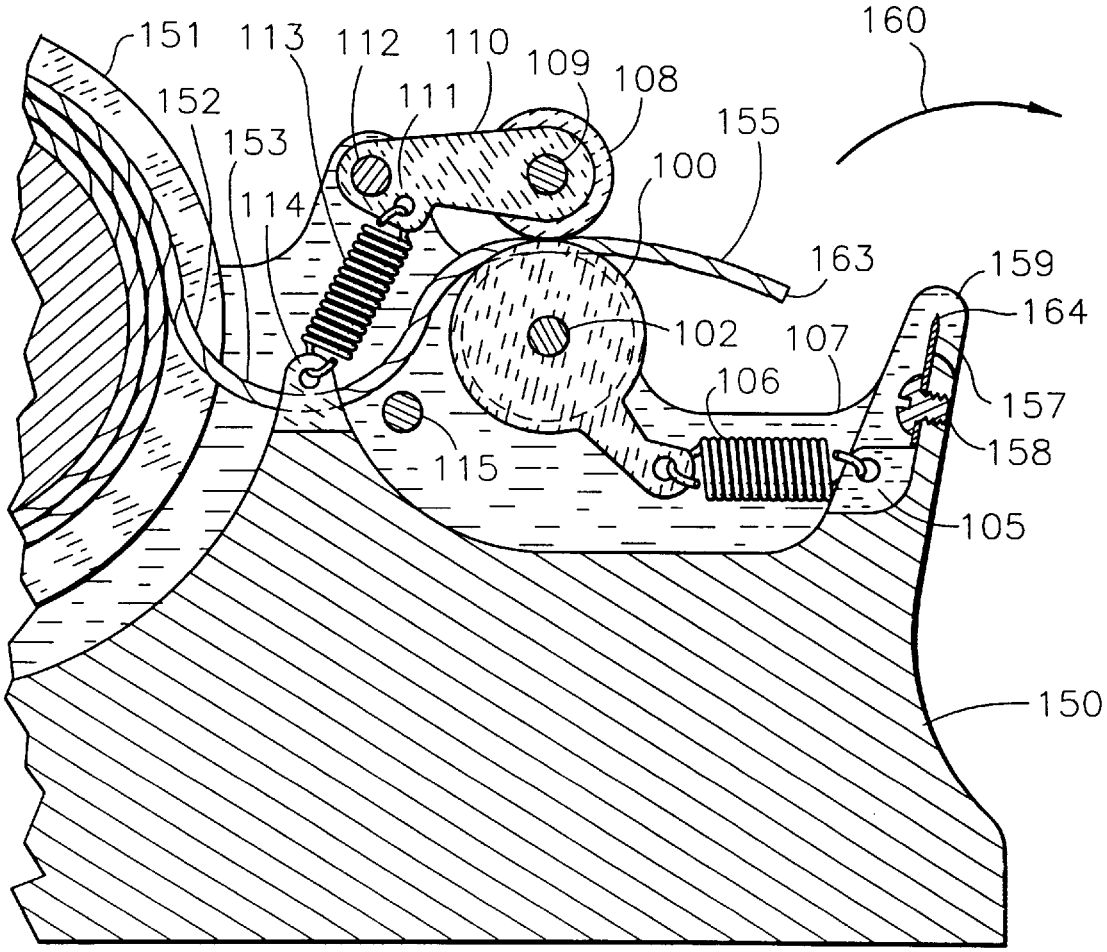
FIG. 2 is a side cross-sectional view of the first embodiment of the present invention in the initial position, ready to dispense a new segment of material.
Figure 3:
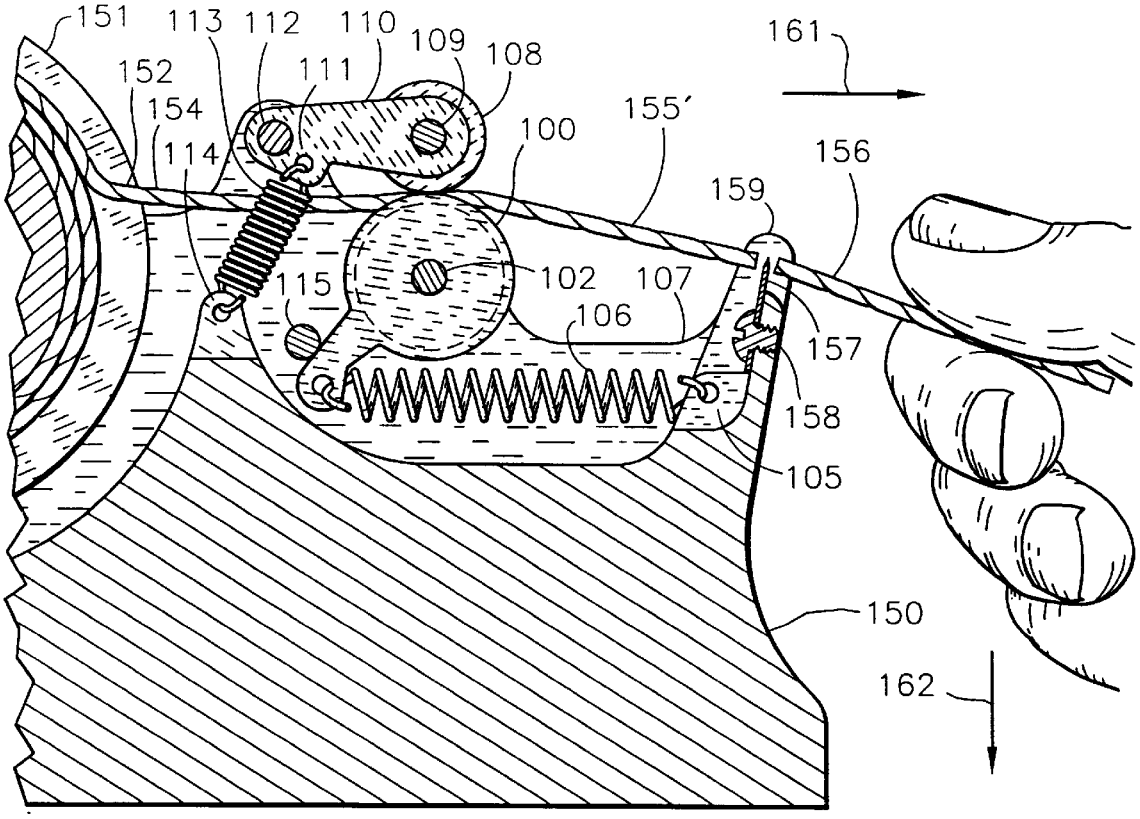
FIG. 3 is a side cross-sectional view of the first embodiment of the present invention at the moment when a new segment of material is cut.

The first embodiment of the present invention is shown in FIGS. 1, 2 and 3. A dispenser base 150 is shown in cross-section and may be considered to have a full construction symmetrical about the cutting plane. Conventional elements include a supply of material 151, a drawn piece of material 152, a cutter 157 with a sharp edge 164, which is fixed relative to the base by a screw 158. There is a side guard 159 adjacent to the cutter on each end to protect the user from being accidentally cut.

There is a grooved roller 100 whose features are shown in FIG. 1 as a groove 101, and an arm 103 having a spring mount 104 at the end. FIG. 2 shows the roller rotatably supported on a shaft 102 which is fitted into a corresponding opening on each internal side of the base 150. The axis of the shaft is fixed relative to the base. A spring anchor 105 is a feature in the base. There is a spring 106 which is attached at one end to the spring mount and to the spring anchor at the other.

A means of engaging the material comprises a wheel 108 which is supported and rotates freely on a shaft 109, which is mounted on an arm 110 which has a spring mount 111 and which pivots about a pin 112 which is fitted into a corresponding opening on each internal side of the base 150. The wheel is forced downward against the drawn piece of material 152 by a spring 113 which is attached at one end to the spring mount, and at the other end to a spring anchor 114. In this way, the wheel is forced against the material to impress the material against the roller.

The spring 113 is sized to provide a force which normally keeps the drawn piece of material 152 engaged on the surface of the grooved roller 100. However, if the grooved roller is stopped from rotating, and if the material is pulled with a certain force or greater, then the material slips advancing an additional length of material. This certain force is presently defined as the "drag force." Therefore, if the pulling force is less than the drag force, then the material will not move relative to a surface of the roller, and if the pulling force is equal to or greater than the drag force, then the material moves relative to the surface of the roller.

There is a bias torque exerted on the grooved roller 100, created by the spring 106 acting upon the arm 103. The bias torque urges the roller to rotate in a reversing rotation direction (which is opposite the feeding rotation direction.) This bias torque causes a bias force to be felt at a surface of the grooved roller by way of resistance to the extended material end being pulled. The value of the bias force changes as a function of the grooved roller angle. However, the spring is sized to provide a bias force which is less than the drag force at every roller angle. The spring is one of many ways of providing a stored energy means, whose energy increases when the roller rotates away from the initial angle in the feeding rotation direction.

The initial (at rest) position of the first embodiment of the present invention is shown in FIG. 2 where the drawn piece of material 152 is engaged on the grooved roller 100, which is at the initial angle (most counterclockwise in this view) stopped by the complete contraction of the spring 106. There is a cutout edge 107 in each side of the base 150 which allows easy finger access to an extended material end 155 which is disposed on the roller in a cantilever manner. To begin the dispensing cycle, the user grasps the extended material end and moves in an initial pull direction shown by an arrow noted by reference numeral 160. Notice that there is a slack shape 153 in the material between the supply of material 151 and the grooved roller. This is a consequence of the final act of the dispensing cycle, which will be described later.

As the extended material end 155 is pulled toward the user (to the right in FIG. 2) the grooved roller 100 rotates in a feeding rotation direction (clockwise in this view) and also the coacting wheel 108 turns (counterclockwise in this view.) Even though the bias force increases as the spring 106 is lengthened, it remains less than the drag force. However, when the arm 103 strikes a stop 115, the pulling force increases to a value which equals or exceeds the drag force. At this point, the tension in the material causes it to slip, advancing an additional length of material. This stop is one of many versions of providing a stopping means for preventing rotation of the roller beyond the cutting angle in the feeding rotation direction.

The user moves in a continued pull direction shown by an arrow noted by reference numeral 161 in FIG. 3. The drawn piece of material 152 is pulled into a straight shape 154 and then additional material is advanced from the supply of material 151 and slips over the grooved roller 100 until a length of material as desired by the user is extended. Finally, the user manually forces the material in a cutting direction as shown by an arrow noted by reference numeral 162, until the material is severed against the sharp edge 164 (FIG. 2) of the cutter 157.

FIG. 3 shows the position where all of the components are located at that moment in time when a segment of material 156 is severed. This segment was previously the extended material end 155 (FIG. 2) plus additional length advanced by the user. After the cut, there is a new extended material end 155' (FIG. 3.)

Just before the position shown in FIG. 3 the continued pulling and tension in the material kept the grooved roller 100 stopped (clockwise in this view) at the cutting angle. But, after the cut is made, the tension is removed so that the grooved roller is free to rotate in the reversing rotation direction, to return to the initial angle, powered by the bias torque provided by the spring 106. Finally, the present invention again looks as shown in FIG. 2. Notice that a surplus of the drawn piece of material 152 forms a slack shape 153 again, and that a cut edge 163 has moved away from the sharp edge 164.

Figure 4:
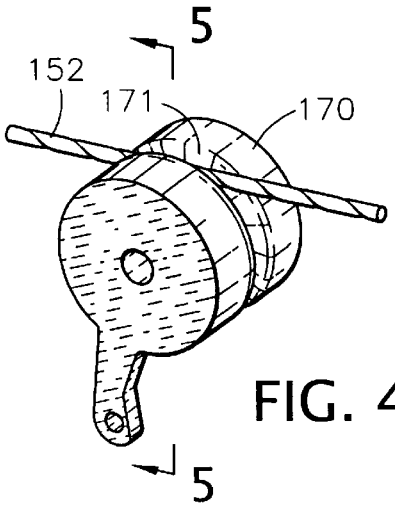
FIG. 4 is a perspective view of a self-engaging roller.
Figure 5:
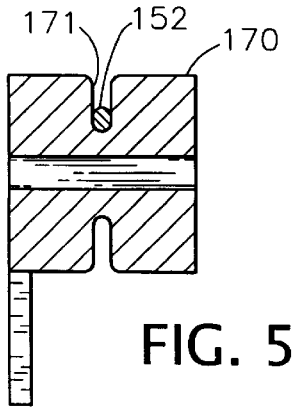
FIG. 5 is a cross-sectional view taken along cutting line 5—5 in FIG. 4

FIGS. 4 and 5 show an alternate means of engaging the material, which is a self-engaging roller 170 with a deep groove 171. The deep groove should have a width slightly less than the diameter of the pliable material which passes through it. This causes a drag force when the material is pulled with a force great enough to cause the material to slip. The advantage of this construction, is that it eliminates the need for a spring-loaded wheel. This means of engaging the material could also be incorporated into the other embodiments of the present invention which follow.

Figure 6A:
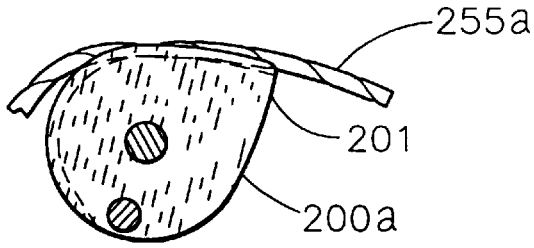
FIG. 6A is a side elevational view of an alternate roller with a ledge.
Figure 6:
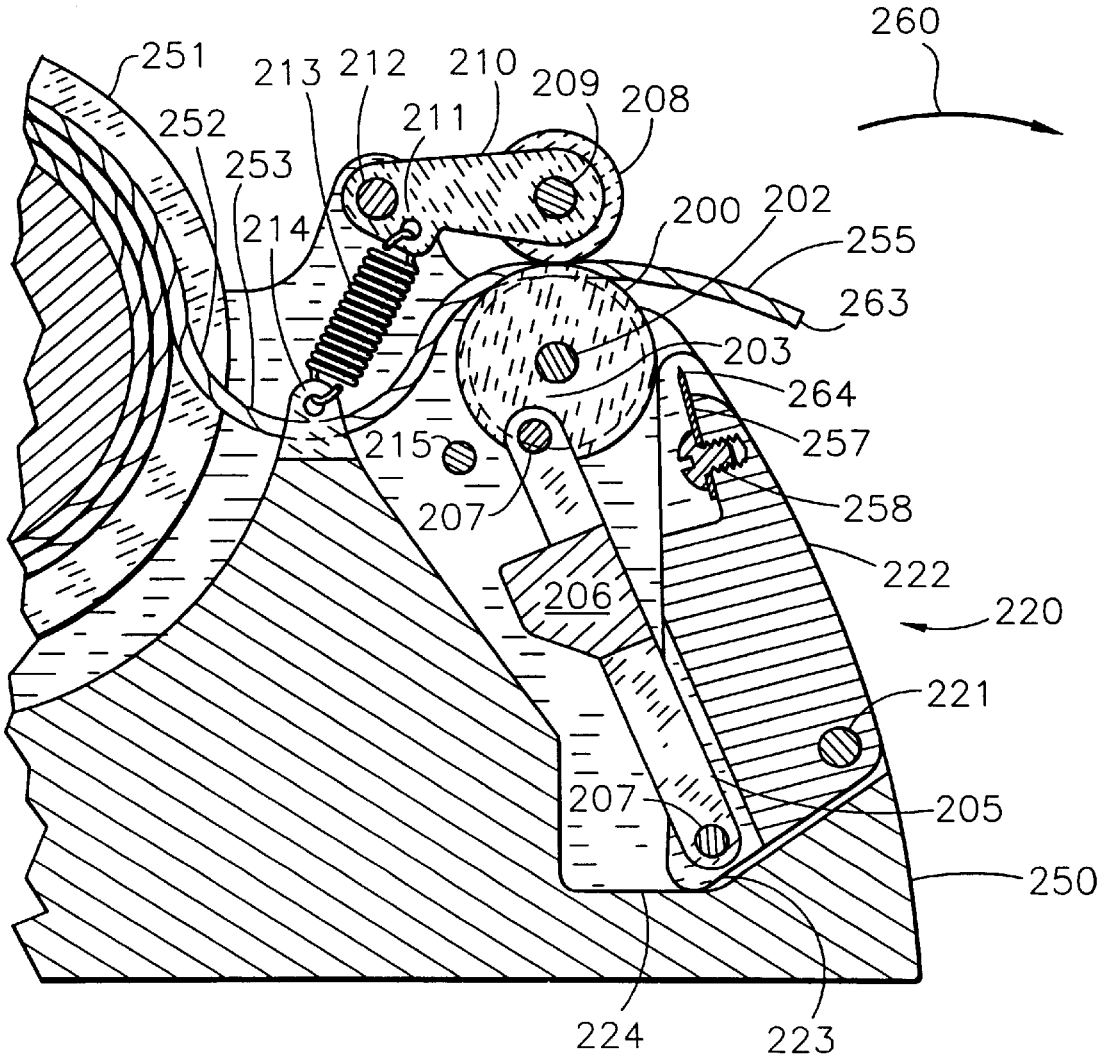
FIG. 6 is a side cross-sectional view of the second embodiment of the present invention in the initial position, ready to dispense a new segment of material.
Figure 7:
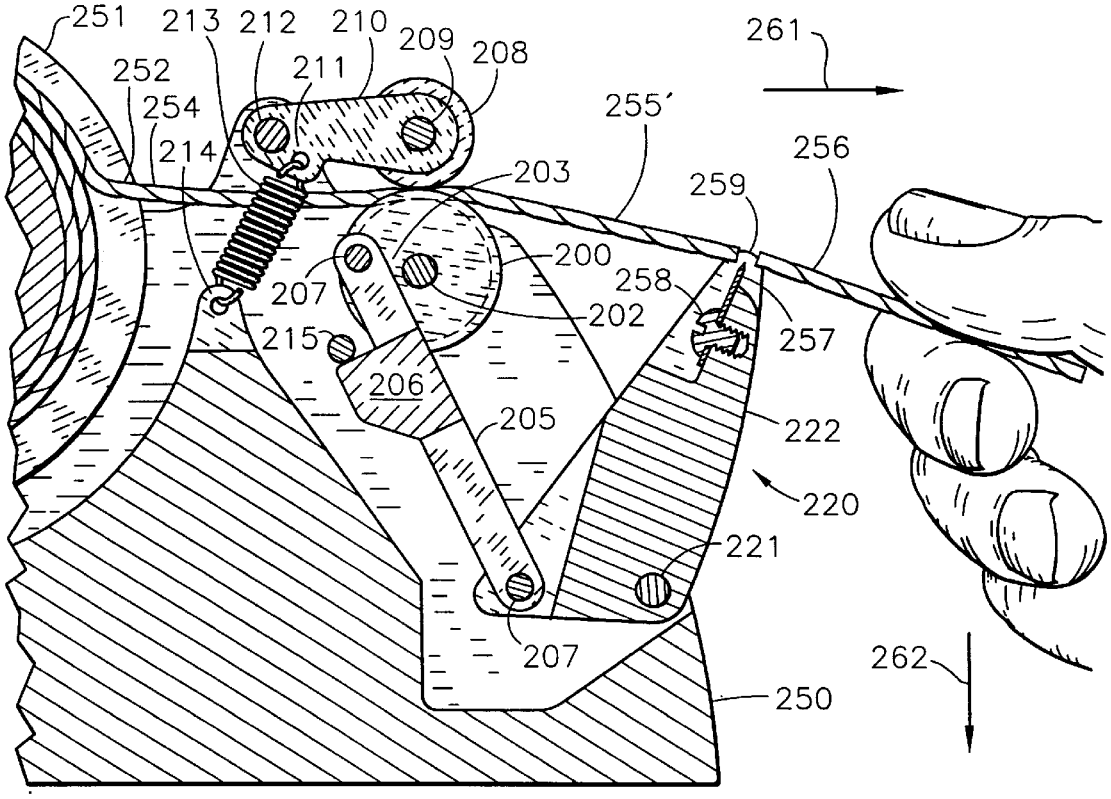
FIG. 7 is a side cross-sectional view of the second embodiment of the present invention at the moment when a new segment of material is cut.

A second embodiment of the present invention is shown in FIGS. 6 and 7. A dispenser base 250 is shown in cross-section and may be considered to have a full construction symmetrical about the cutting plane. Conventional elements include a supply of material 251, a drawn piece of material 252, a cutter blade 257 with a sharp edge 264, which is held in place by a screw 258. There is a side guard 259 adjacent to the cutter blade on each end to protect the user from being accidentally cut.

There is a grooved roller 200 which has a groove similar to that shown by reference numeral 101 in FIG. 1. The grooved roller is rotatably supported on a shaft 202, which is fitted into a corresponding opening on each internal side of the base 250. The axis of the shaft is fixed relative to the base. There is a sector of the roller between the shaft 202 and a hole to receive a link pin 207, which acts as an arm 203.

A means of engaging the material comprises a wheel 208 which is supported and rotates freely on a shaft 209, which is mounted on an arm 210 which has a spring mount 211 and which pivots about a pin 212 which is fitted into a corresponding opening on each internal side of the base 250. The wheel is forced downward against the drawn piece of material 252 by a spring 213 which is attached at one end to the spring mount, and at the other end to a spring anchor 214. In this way, the wheel is forced against the material to impress the material against the roller.

The spring 213 is sized to provide a force which normally keeps the drawn piece of material 252 engaged on the surface of the grooved roller 200. However, if the grooved roller is stopped from rotating, and if the material is pulled with a certain force or greater, then the material slips advancing of an additional length of material. This certain force is presently defined as the "drag force." Therefore, if the pulling force is less than the drag force, then the material will not move relative to a surface of the roller, and if the pulling force is equal to or greater than the drag force, then the material moves relative to the surface of the roller.

FIG. 6A shows an alternate grooved roller 200*a* which has a ledge 201 whose function it is to help support an extended material end 255*a* out in a more horizontal straight shape. The ledge is one of many non-cylindrical shapes that acts as an "end support means." This means could also be comprised in the first embodiment of the present invention.

There is a cutter 220 which is movably supported about a shaft 221. A cutter arm 222 supports the cutter blade 257, with the sharp edge 264, the screw 258, and the side guard 259. The cutter is movable relative to the base and is also movable relative to the axis of the grooved roller 200. While this embodiment shows a cutter which rotates, an alternate embodiment (not shown for brevity) could utilize a cutter which instead translates.

There is a link 205 which is connected by a link pin 207 at each end, to the arm 203 of the grooved roller 200, and to the cutter 220. The link acts as a means of powering the cutter, where the link is pivotably connected at a first end to the arm, and which is pivotably connected at a second end to the cutter. If the roller rotates, then the link moves the cutter, and if the roller stops then the link stops the cutter. The link is designed so that when the roller is at the initial angle, then the cutter is at a start position; and if the roller is at a cutting angle, then the cutter is at a severing position. A feature of the link is a weight 206.

There is a bias torque exerted on the grooved roller 200, created by the unbalanced weight of all of the moving parts (including the weight 206) acting upon the arm 203. The bias torque urges the grooved roller to rotate in a reversing rotation direction (counterclockwise in FIG. 6.) This bias torque causes a bias force to be felt at a surface of the grooved roller by way of resistance to the extended material end being pulled. The value of the bias force changes as a function of the grooved roller angle. However, the weight is sized to provide a bias force which is less than the drag force at every roller angle. The weight is one of many ways of providing a stored energy means, whose energy increases when the roller rotates away from the initial angle in the feeding rotation direction.

The initial (at rest) position of the second embodiment of the present invention is shown in FIG. 6 where the drawn piece of material 252 is engaged to the grooved roller 200, which is at an initial angle (most counterclockwise in this view), stopped by a foot 223 impinging on a floor stop 224. An extended material end 255 is disposed on the roller in a cantilever manner. To begin the dispensing cycle, the user grasps the extended material end and moves in an initial pull direction shown by an arrow noted by reference numeral 260. Notice that there is a slack shape 253 in the material between the supply of material 251 and the grooved roller. This is a consequence of the final act of the dispensing cycle, which will be described later.

As the extended material end 255 is pulled toward the user (to the right in FIG. 6) the grooved roller 200 rotates in a feeding rotation direction (clockwise in this view.) Even though the bias force increases as the weight 206 is lifted, it remains less than the drag force. However, when the weight strikes a stop 215, the pulling force increases to a value which equals or exceeds the drag force. At this point, the tension in the material causes it to slip, advancing an additional length of material. This stop is one of many versions of providing a stopping means for preventing rotation of the roller beyond a cutting angle in the feeding rotation direction.

The user moves in a continued pull direction shown by an arrow noted by reference numeral 261 in FIG. 7. The drawn piece of material 252 is pulled into a straight shape 254 and then additional material is advanced from the supply of material 251 and slips over the grooved roller 200 until a length of material as desired by the user is extended. Finally, the user manually forces the material in a cutting direction as shown by an arrow noted by reference numeral 262, until the material is severed against the sharp edge 264 (FIG. 6) of the cutter blade 257.

FIG. 7 shows the position where all of the components are located at that moment in time when a segment of material 256 is severed. The cutter 220 is shown at the severing position. This segment was previously the extended material end 255 (FIG. 6) plus additional length advanced by the user. After the cut, there is a new extended material end 255' (FIG. 7.)

Just before the position shown in FIG. 7 the continued pulling and tension in the material kept the grooved roller 200 stopped (clockwise in this view) at the cutting angle. But, after the cut is made, the tension is removed so that the grooved roller is free to rotate in the reversing rotation direction, to return to the initial angle, powered by the bias torque provided by the weight 206. Simultaneously, the cutter 220, returns to the start position, powered by the link 205. Finally, the present invention again looks as shown in FIG. 6. Notice that a surplus of the drawn piece of material 252 forms a slack shape 253 again, and that a cut edge 263 has moved away from the sharp edge 264.

The first and second embodiments of the present invention are directed at a dispenser of a filament-like material of indeterminate length, by having a groove feature. However, by making slight changes, such as providing a very wide non-grooved roller, and using a very wide wheel, one can easily envision alternate embodiments of the present invention which dispense web-like material of indeterminate length. These embodiments, while not shown for the sake of brevity, are envisioned to be within the scope of what will be later claimed of the present invention.

The third, fourth, and fifth embodiments of the present invention are directed more specifically toward a manually powered tape dispenser for dispensing segments of tape of the type which has adhesive on at least one side.

Figure 8:
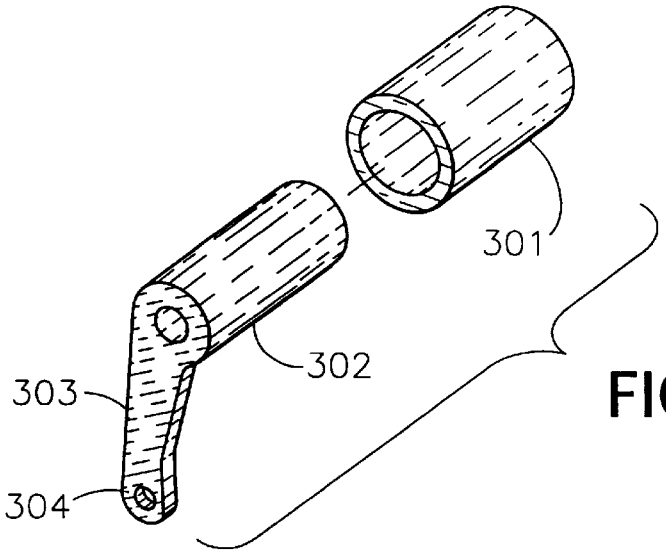
FIG. 8 is an exploded perspective view of an outer roller and an inner roller.
Figure 9:
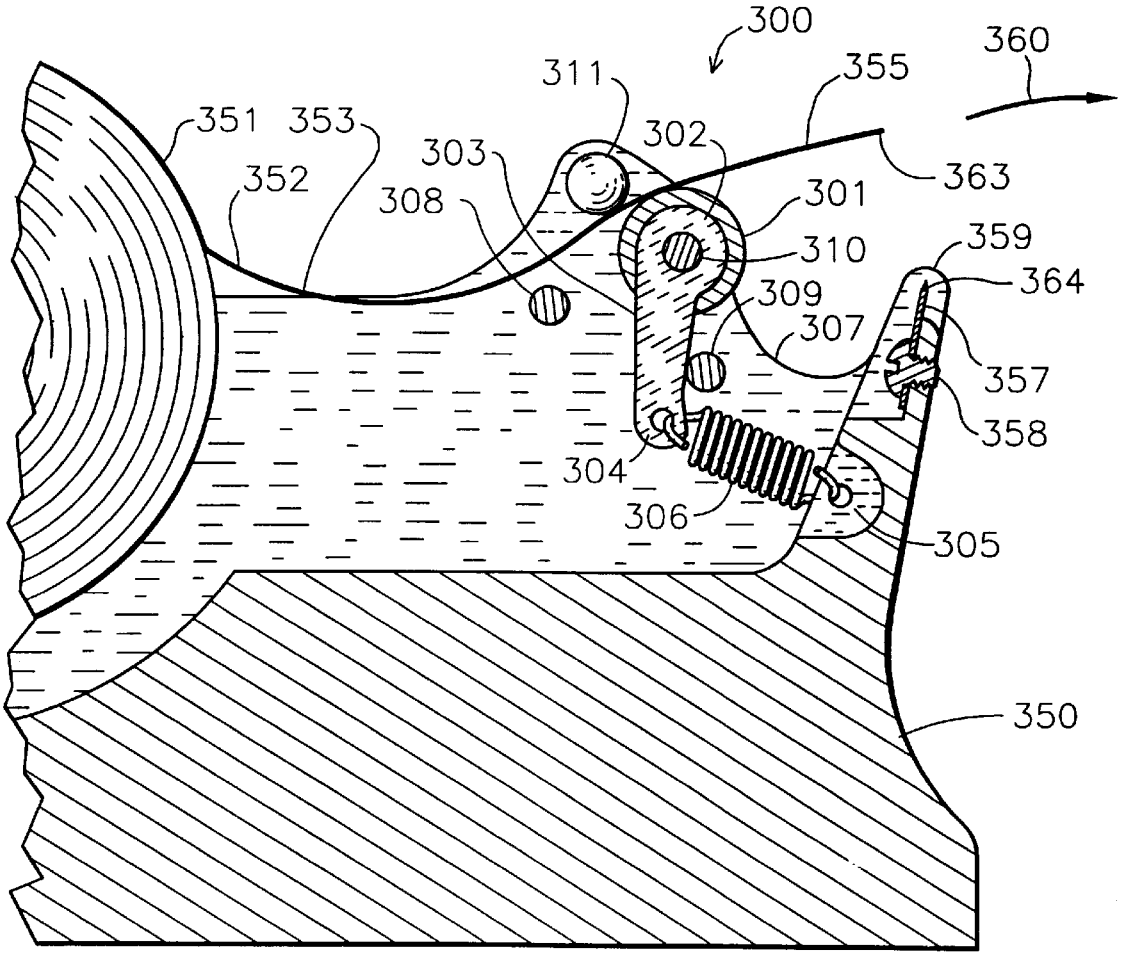
FIG. 9 is a side cross-sectional view of the third embodiment of the present invention in the initial position, ready to dispense a new segment of tape.
Figure 10:
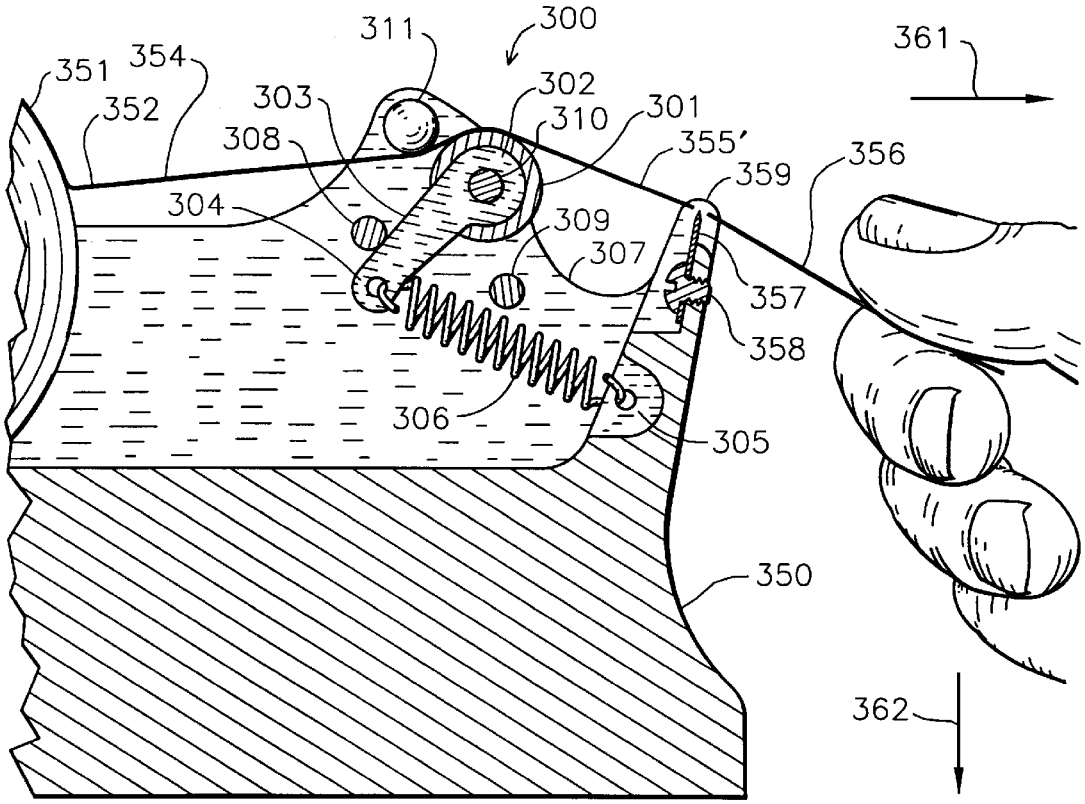
FIG. 10 is a side cross-sectional view of the third embodiment of the present invention at the moment when a new segment of tape is cut.

The third embodiment of the present invention is shown in FIGS. 8, 9, and 10. A tape dispenser base 350 is shown in cross-section and may be considered to have a full construction symmetrical about the cutting plane. Conventional elements include a roll of tape 351, a drawn piece of tape 352, a cutter 357 with a sharp edge 364, which is fixed relative to the base by a screw 358. There is a side guard 359 adjacent to the cutter on each end to protect the user from being accidentally cut.

There is a roller assembly 300 whose features are shown in FIG. 8 as an outer roller 301, and an inner roller 302, which has an arm 303, whose end has a spring mount 304. FIG. 9 shows the roller assembly rotatably supported on a shaft 310 which is fitted into a corresponding opening on each internal side of the base 350. The axis of the shaft is fixed relative to the base. The inner roller has a rotation limited between an initial angle and a cutting angle, and has a feeding rotation direction when it rotates away from the initial angle, and a reversing rotation direction which is opposite the feeding rotation direction. A spring anchor 305 is a feature in the base. There is a spring 306 which is attached at one end to the spring mount and to the spring anchor at the other.

For purposes of illustration, there is a slight frictional fit of the outer roller 301 on the inner roller 302, so that they would ordinarily turn together. However, if the inner roller is stopped from turning, then there is a certain torque at which the outer roller slips and rotates around the inner roller. The torque at which outer roller slips is presently defined as the "drag torque." The interference fit is only one of many ways to provide a means of slipping frictional contact. Another construction could include a spring-loaded friction disk. The drag torque causes a drag force to be felt at a surface of the outer roller by way of resistance to the extended tape end being pulled. Therefore, if the inner roller is stopped, and if a pulling force which is less than the drag force is exerted on an extended tape end, then the outer roller will not rotate. And if the inner roller is stopped, and if a pulling force which is equal to or greater than the drag force is exerted on an extended tape end, then the outer roller rotates.

There is a bias torque exerted on the inner roller 302, created by the spring 306 acting upon the arm 303. The bias torque urges the inner roller to rotate in a reversing rotation direction (which is opposite the feeding rotation direction.) This bias torque causes a bias force to be felt at a surface of the outer roller by way of resistance to the extended tape end being pulled. The value of the bias force changes as a function of the inner roller angle. However, the spring is sized to provide a bias force which is less than the drag force at every inner roller angle. The spring is one of many ways of providing a stored energy means, whose energy increases when the inner roller rotates away from the initial angle in the feeding rotation direction.

The initial (at rest) position of the third embodiment of the present invention is shown in FIG. 9 where the drawn piece of tape 352 passes under the keeper 311 and is engaged or adhered to the outer roller 301. The keeper is a cantilever non-rotating shaft whose purpose is to keep the tape from lifting off the roller in the event the user lifts too much while extending the tape. If the tape has adhesive on both sides, then the keeper could be designed as a rotating roller. However, the present invention will work without a keeper at all, so long as one side of the tape is adhered to the outer roller. The inner roller 302 is shown at the initial angle (most counterclockwise in this view), stopped by the arm 303 impinging on a right stop 309. There is a cutout edge 307 in each side of the base 350 which allows easy finger access to an extended tape end 355, which is disposed on the outer roller in a cantilever manner. To begin the dispensing cycle, the user grasps the extended tape end and moves in an initial pull direction shown by an arrow noted by reference numeral 360. Notice that there is a slack shape 353 in the tape between the roll of tape 351 and the roller assembly 300. This is a consequence of the final act of the dispensing cycle, which will be described later.

As the extended tape end 355 is pulled toward the user (to the right in FIG. 9) the roller assembly 300 rotates in a feeding rotation direction (clockwise in this view.) Even though the bias force increases as the spring 306 is lengthened, it remains less than the drag force. However, when the arm 303 strikes the left stop 308, the pulling force increases to a value which equals or exceeds the drag force. At this point, the outer roller slips, allowing an additional length of tape to be advanced. This stop is one of many versions of providing a stopping means for preventing rotation of the inner roller beyond a cutting angle in the feeding rotation direction.

The user moves in a continued pull direction shown by an arrow noted by reference numeral 361 in FIG. 10. The drawn piece of tape 352 is pulled into a straight shape 354 and then additional tape is advanced from the roll of tape 351 (even while continuously adhered to the outer roller 301) until a length of material as desired by the user is extended. Finally, the user manually forces the material in a cutting direction as shown by the arrow noted by reference numeral 362, until the material is severed against the sharp edge 364 (FIG. 9) of the cutter 357.

FIG. 10 shows the position where all of the components are located at that moment in time when a segment of material 356 is severed. This segment was previously the extended tape end 355 (FIG. 9) plus additional length advanced by the user. After the cut, there is a new extended tape end 355' (FIG. 10.)

Just before the position shown in FIG. 10 the continued pulling and tension in the tape kept the inner roller 302 stopped (clockwise in this view) at the cutting angle. But, after the cut is made, the tension is removed so that the inner roller is free to rotate in the reversing rotation direction and to return to the initial angle along with the outer roller on which the new extended tape end 355' is adhered, powered by the bias torque provided by the spring 306. Finally, the present invention again looks as shown in FIG. 9. Notice that a surplus of the drawn piece of tape 352 forms a slack shape 353 again, and that a cut edge 363 has moved away from the sharp edge 364.

Figure 11:
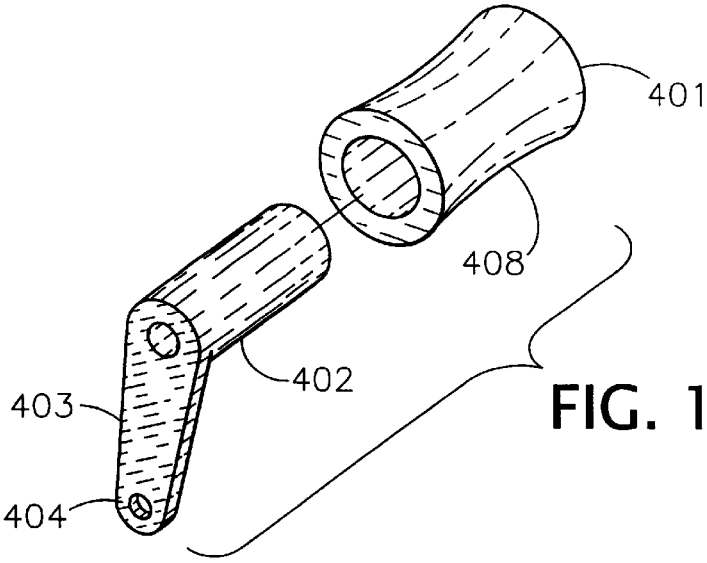
FIG. 11 is an exploded perspective view of a cambered outer roller and an inner roller.
Figure 12:
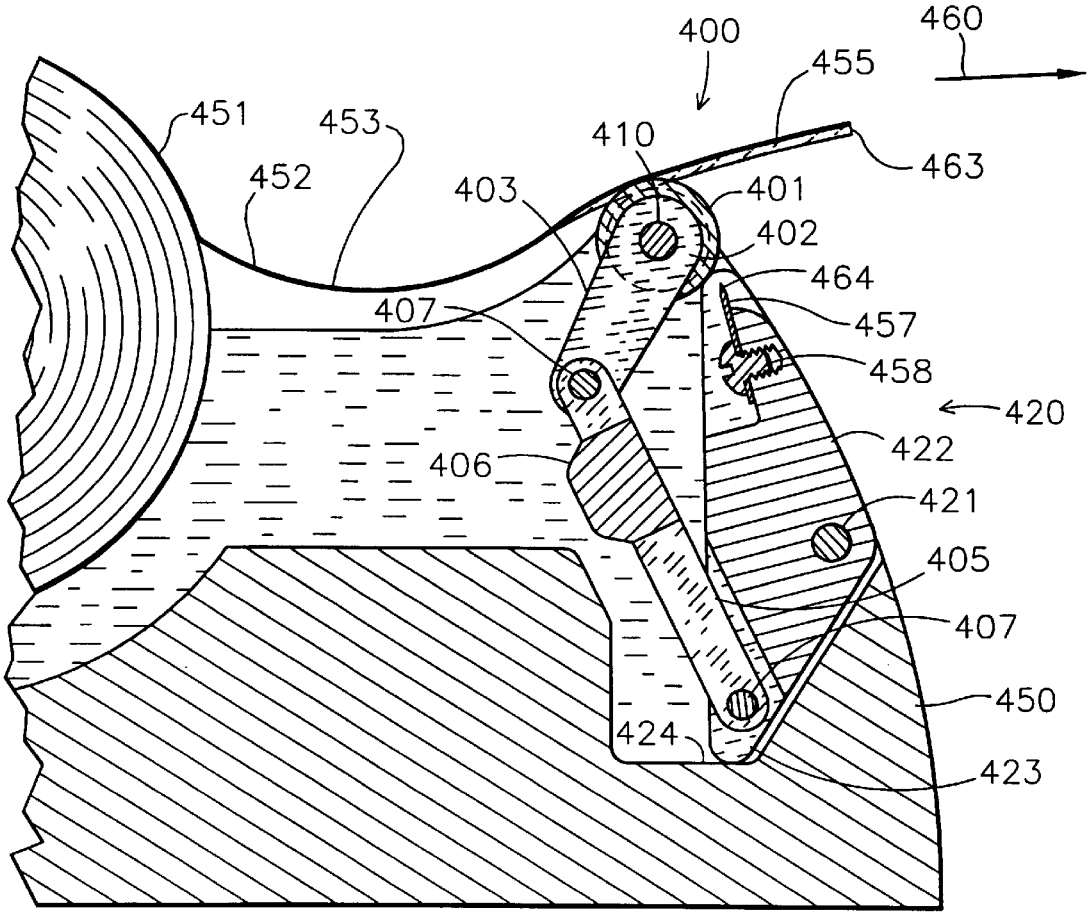
FIG. 12 is a side cross-sectional view of the fourth embodiment of the present invention in the initial position, ready to dispense a new segment of tape.
Figure 13:
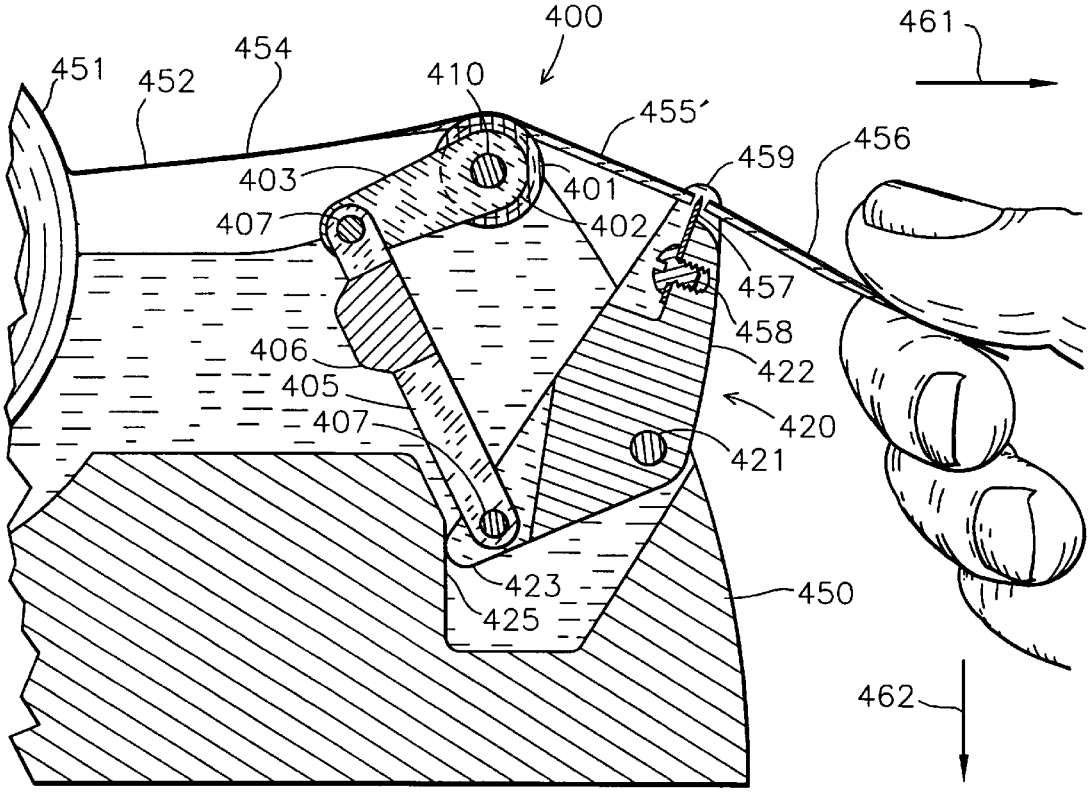
FIG. 13 is a side cross-sectional view of the fourth embodiment of the present invention at the moment when a new segment of tape is cut.

The fourth and preferred embodiment of the present invention is shown in FIGS. 11, 12, and 13. A tape dispenser base 450 is shown in cross-section and may be considered to have a full construction symmetrical about the cutting plane. Conventional elements include a roll of tape 451, and a drawn piece of tape 452.

There is a roller assembly 400 whose features are shown in FIG. 11 as an outer roller 401, and an inner roller 402, which has an arm 403, whose end has a pin hole 404. FIG. 12 shows the inner roller rotatably supported on a shaft 410 which is fixed into a corresponding opening on each internal side of the base 450. The axis of the shaft is fixed relative to the base. The inner roller has a rotation limited between an initial angle and a cutting angle, and has a feeding rotation direction when it rotates away from the initial angle, and a reversing rotation direction which is opposite the feeding rotation direction. The outer roller has a cambered surface 408 (FIG. 11) which causes an extended tape end 455 to be supported in a straight shape and in a cantilever manner. This cambered shape could also be utilized on other embodiments of the present invention.

For purposes of illustration, there is a slight interference fit of the outer roller 401 on the inner roller 402, so that they would ordinarily turn together. However, if the inner roller is stopped from turning, then there is a certain torque at which the outer roller slips and rotates around the inner roller. The torque at which outer roller slips is presently defined as the "drag torque." The interference fit is only one of many ways to provide a means of slipping frictional contact. Another construction could include a spring-loaded friction disk. The drag torque causes a drag force to be felt at a surface of the outer roller by way of resistance to the extended tape end being pulled. Therefore, if the inner roller is stopped, and if a pulling force which is less than the drag force is exerted on an extended tape end, then the outer roller will not rotate. And if the inner roller is stopped, and if a pulling force which is equal to or greater than the drag force is exerted on an extended tape end, then the outer roller rotates.

There is a cutter 420 which is movably supported about a shaft 421. A cutter arm 422 supports a cutter blade 457 with a sharp edge 464, which is held in place by a screw 458. There is a side guard 459 adjacent to the cutter blade on each end to protect the user from being accidentally cut. The cutter is movable relative to the base and is also movable relative to the axis of the roller assembly 400. While this embodiment shows a cutter which rotates, an alternate embodiment (not shown for brevity) could utilize a cutter which instead translates.

There is a link 405 which is connected by a link pin 407 at each end, to the pin hole 404 and to the cutter 420. The link acts as a means of powering the cutter, where the link is pivotably connected at a first end to the arm 403, and which is pivotably connected at a second end to the cutter. If the inner roller 402 rotates, then the link moves the cutter, and if the inner roller stops then the link stops the cutter. The link is designed so that when the inner roller is at the initial angle, then the cutter is at a start position; and if the inner roller is at a cutting angle, then the cutter is at a severing position. A feature of the link is a weight 406.

There is a bias torque exerted on the inner roller 402, created by the unbalanced weight of all of the moving parts (including the weight 406) acting upon the arm 403. The bias torque urges the inner roller to rotate in a reversing rotation direction (counterclockwise in FIG. 12.) This bias torque causes a bias force to be felt at a surface of the outer roller by way of resistance to the extended tape end being pulled. The value of the bias force changes as a function of the inner roller angle. However, the weight is sized to provide a bias force which is less than the drag force at every inner roller angle. The weight is one of many ways of providing a stored energy means, whose energy increases when the inner roller rotates away from the initial angle in the feeding rotation direction.

The initial (at rest) angle of the fourth embodiment of the present invention is shown in FIG. 12 where the drawn piece of tape 452 is adhered to the outer roller 401. The inner roller 402 is at the initial angle (most counterclockwise in this view) stopped by a foot 423 impinging on a floor stop 424. To begin the dispensing cycle, the user grasps the extended tape end 455 and moves in an initial pull direction shown by an arrow noted by reference numeral 460. Notice that there is a slack shape 453 in the tape between the roll of tape 451 and the roller assembly 400. This is a consequence of the final act of the dispensing cycle, which will be described later.

As the extended tape end 455 is pulled toward the user, the roller assembly 400 rotates in the feeding rotation direction (clockwise in this view.) Even though the bias force increases as the weight 406 is lifted, it remains less than the drag force. However, the inner roller stops turning when a foot 423 strikes a wall stop 425 (FIG. 13.) This stop is one of many ways of providing a stopping means for preventing rotation of the inner roller beyond the cutting angle in the feeding rotation direction. When the inner roller is stopped, the pulling force increases to a value which equals or exceeds the drag force. At this point, the tension in the tape causes the outer roller to slip, advancing an additional length of tape.

The user moves in a continued pull direction shown by an arrow noted by reference numeral 461 in FIG. 13. The drawn piece of tape 452 is pulled into a straight shape 454 and then additional tape is advanced from the roll of tape 451 (even while continuously adhered to the outer roller 401) until a length of tape as desired by the user is extended. Finally, the user manually forces the tape in a cutting direction as shown by an arrow noted by reference numeral 462, until the tape is severed against the sharp edge 464 (FIG. 12) of the cutter blade 457.

FIG. 13 shows the position where all of the components are located at that moment in time when a segment of tape 456 is cut. The cutter is shown in the severing position. This segment was previously the extended tape end 455 (FIG. 12) plus additional length advanced by the user. After the cut, there is a new extended tape end 455' (FIG. 13.)

Just before the position shown in FIG. 13 the continued pulling and tension in the tape kept the inner roller 402 stopped (clockwise in this view) at the cutting angle. But, after the cut is made, the tension is removed so that the inner roller is free to rotate in the reversing rotation direction, and to return to the initial angle along with the outer roller on which the new extended tape end 455' is adhered, powered by the bias torque provided by the weight 406. Simultaneously, the cutter 420, returns to the start position, powered by the link 405. Finally, the present invention again looks as shown in FIG. 12. Notice that a surplus of the drawn piece of tape 452 forms a slack shape 453 again, and that a cut edge 463 has moved away from the sharp edge 464.

The fourth embodiment of the present invention is preferred because, after the cut, the linkage tilts the extended tape end 455 up, while retracting the cutter 420 into the base 450, thus providing the best finger access to the extended tape end.

The third and fourth embodiments of the present invention show the outer roller (301,401) fitting around the inner roller (302,402). However, an alternate embodiment of the present invention (not shown for brevity) could be constructed where the two rollers are supported side-by-side on a common shaft, and where the ends of the rollers rub together to provide the means of frictional rotary connection. This being the case, a more general way of naming the rollers (those shown in the third and fourth embodiments of the present invention) is where the inner roller is also called a "first roller" and where the outer roller is also called a "second roller."

Figure 14:
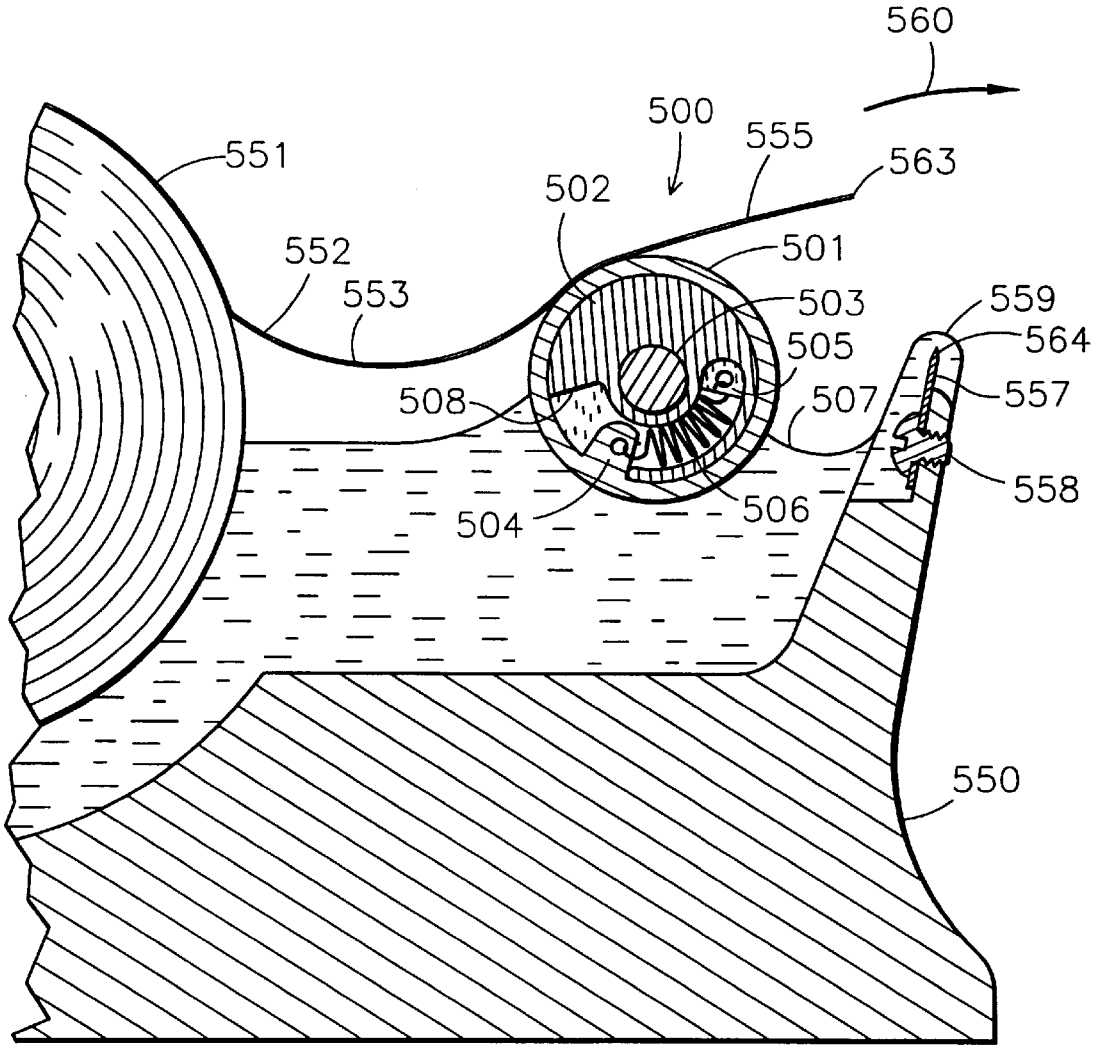
FIG. 14 is a side cross-sectional view of the fifth embodiment of the present invention in the initial position, ready to dispense a new segment of tape.
Figure 15:
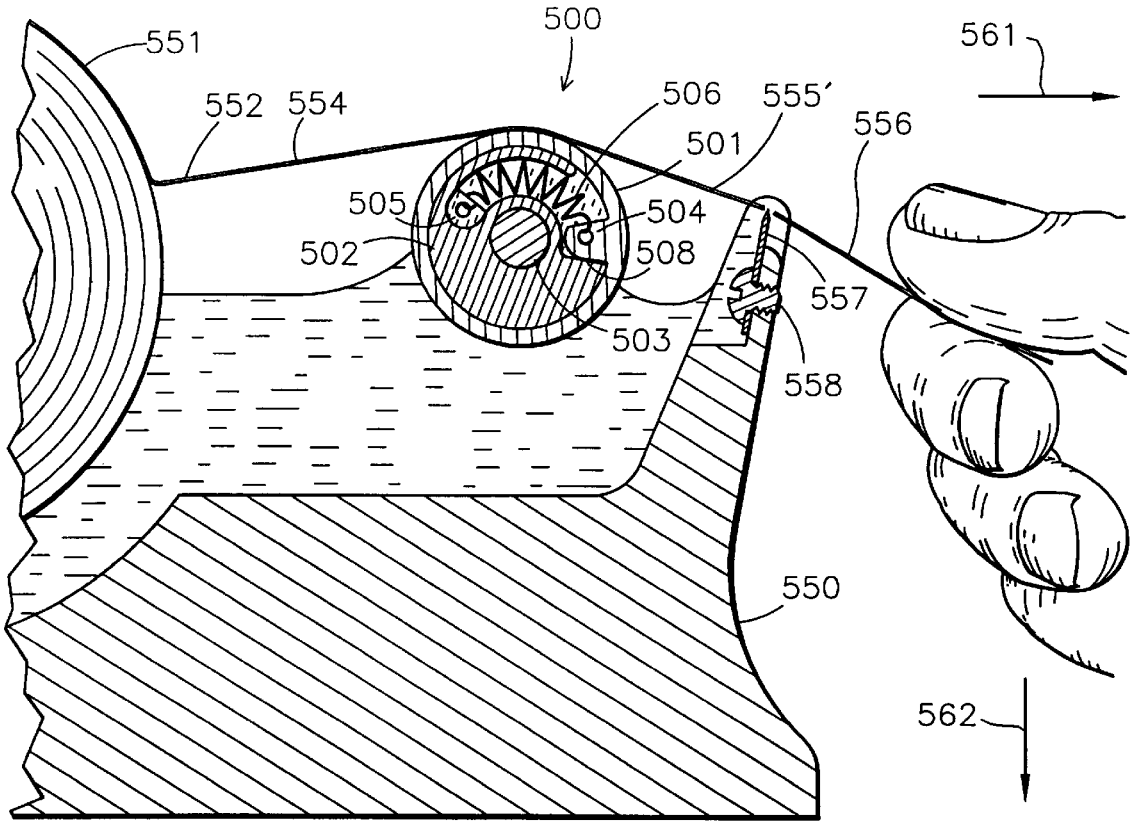
FIG. 15 is a side cross-sectional view of the fifth embodiment of the present invention at the moment when a new segment of tape is cut.
Figure 16:
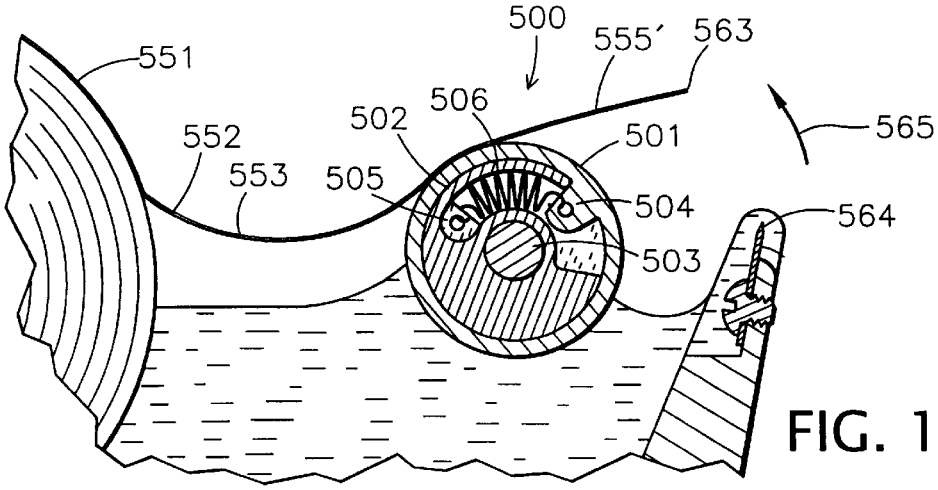
FIG. 16 is a partial side cross-sectional view of the fifth embodiment of the present invention after returning to the initial position.

The fifth embodiment of the present invention is shown in FIGS. 14, 15, and 16. The fifth embodiment is similar to the third embodiment and functions identically, but the components of the roller assembly have been rearranged. A tape dispenser base 550 is shown in cross-section and may be considered to have a full construction symmetrical about the cutting plane. Conventional elements include a roll of tape 551, a drawn piece of tape 552, a cutter 557 with a sharp edge 564, which is fixed relative to the base by a screw 558. There is a side guard 559 adjacent to the cutter on each end to protect the user from being accidentally cut.

There is a roller assembly 500 which comprises an outer roller 501, also called a secondary roller, which rotates freely about an inner roller 502, also called a primary roller. The outer roller has a spring lug 504, and the inner roller has a spring anchor 505. There is a spring 506 which is attached at one end to the spring lug and to the spring anchor at the other. FIG. 14 shows the roller assembly mounted on fixed axle 503 which is mounted with a non-rotating fit into a corresponding opening on each internal side of the base 550.

For purposes of illustration, there is a slight frictional fit of the inner roller 502 on the fixed axle 503, which would ordinarily prevent the inner roller from turning. This slight frictional fit is one of many ways of providing a means of slipping frictional contact. (For example, a spring-loaded friction disk, and the like, could also be utilized.) However, there is a certain torque at which the inner roller slips and rotates around the fixed axle. This torque is presently defined as the "drag torque." The drag torque causes a drag force to be felt at a surface of the outer roller by way of resistance to the extended tape end being pulled. Therefore, if the outer roller 501 is stopped from rotating relative to the inner roller, and if a pulling force which is less than the drag force is exerted upon the extended tape end, then the inner roller will not rotate relative to the axle, but if the pulling force is equal to or greater than the drag force, then the inner roller slips and rotates relative to the axle;

There is a bias torque on the outer roller 501, created by the spring 506 acting upon the spring lug 504. This bias torque causes a bias force to be felt at a surface of the outer roller by way of resistance to the extended tape end being pulled. The value of the bias force changes as a function of the relative angle between the inner and outer rollers. However, the spring is sized to provide a bias force which is less than the drag force at every outer roller angle. (The bias torque could also be provided by a torsion spring, resulting in an alternate embodiment of the present invention which has a smaller roller assembly.) The spring is one of many ways of providing a stored energy means, whose energy increases when the outer roller rotates away from the initial angle in the feeding rotation direction.

The initial (at rest) position of the fifth embodiment of the present invention is shown in FIG. 14 where the drawn piece of tape 552 is adhered to the outer roller 501. The inner roller 502 is held steady by the slight frictional fit on the fixed axle 503. The outer roller is at an initial angle (most counter-clockwise in this view), stopped by the complete contraction of the spring 506 . There is a cutout edge 507 in each side of the base 550 which allows easy finger access to an extended tape end 555 which is disposed on the outer roller in a cantilever manner. To begin the dispensing cycle, the user grasps the extended tape end and moves in an initial pull direction shown by an arrow noted by reference numeral 560. Notice that there is a slack shape 553 in the tape between the roll of tape 551 and the roller assembly 500. This is a consequence of the final act of the dispensing cycle, which will be described later.

Initially, as the extended tape end 555 is pulled toward the user (to the right in FIG. 14), only the outer roller 501 rotates (clockwise in this view.) Even though the bias force increases as the spring 506 is lengthened, it remains less than the drag force. However, when the spring lug 504 strikes the stop 508 as shown in FIG. 15, the pulling force increases to a value which equals or exceeds the drag force. At this point, the inner roller slips around the fixed axle 503, allowing both rollers to turn in unison, advancing an additional length of tape. The stop is one of many versions of providing a stopping means for preventing rotation of the outer roller beyond a cutting angle in the feeding rotation direction.

The user moves in a continued pulling direction shown by an arrow noted by reference numeral 561 in FIG. 15. The drawn piece of tape 552 is pulled into a straight shape 554 and then additional tape is advanced from the roll of tape 551 (even while continuously adhered to the outer roller 501) until a length of tape as desired by the user is advanced. Finally, the user strokes the tape in a cutting direction as shown by an arrow noted by reference numeral 562, by which the additional length of tape is manually forced against the sharp edge 564 (FIG. 14) of the cutter 557 causing it to sever.

FIG. 15 shows the position where all of the components are located at that moment in time when a segment of tape 556 is severed. This segment was previously the extended tape end 555 (FIG. 14) plus additional length advanced by the user. After the cut, there is a new extended tape end 555' (FIG. 15.)

Just before the position shown in FIG. 15 the continued pulling and tension in the tape kept the outer roller 501 stopped clockwise relative to the inner roller 502. But, after the cut is made, the tension is removed so that the outer roller is free to rotate in the reversing rotation direction and to return to the initial angle (relative to the inner roller) along with the new extended tape end 555', powered by the bias torque provided by spring 506. Finally, the present invention looks as shown in FIG. 16. Notice that the inner roller has not moved in FIG. 16 from its position shown in FIG. 15, due to its frictional fit on fixed axle 503. A surplus of the drawn piece of tape 552 forms a slack shape 553 again, and a cut edge 563 has moved and rotated in the reversing rotation direction shown by an arrow noted by reference numeral 565, away from the sharp edge 564.

The outer roller (301, 401, and 501) of the third, fourth, and fifth embodiments of the present invention are able to rotate back to the initial angle, after the cut is made, because the bias force also acts to unstick the cut edge (363, 463, and 563) from the sharp edge (364, 464, and 564.) Therefore, the bias force must be large enough to unstick the cut edge, and also to reliably return the roller assembly to the initial angle.

Many inventions of prior art include a brake to stop the material while being cut. However, a unique feature of the present invention is that the material may still be extended during the cut. Yet, it is desirable to hold the material steady for achieving a clean cut. This is accomplished by making the drag force significant, while not so large as to discourage the user.

Each of the cutters and cutter blades shown by reference numerals 157, 257, 357,457, and 557, is shown attached by a screw (158, 258, 358, 458, and 558). However, the cutter blade could also be fitted into a slot or it could be made an integral feature of the cutter (and not a separate part.) The cutter blade is shown having a sharp edge, which can be serrated, vee-notched, or uninterrupted, and can be straight or nonstraight.

Since it would be more convenient to use the present invention with one hand, it is desirable that the base be weighted sufficiently to prevent it from moving across the table.

Since the drag force is provided by friction, it is now instructive to discuss the nature of a slipping friction action. A static friction force may be greater than a dynamic friction force. With respect to the present invention, when making comparisons to the value of the bias force, and when pulling to advance the material, the value of the drag force is determined by the dynamic friction characteristics. However, when describing the action at the instant when the material or roller slips, the drag force is determined by the static friction characteristics.

Although the need for (and means of providing) bias torque and bias force has been discussed, the device which provides this torque is more properly defined as a "stored energy" device. This is because some of the energy of pulling the material is stored, and then released to create a "torque acting about an angle of rotation" to return the roller. Springs and weights are convenient stored energy means, but there are other well-known stored energy devices which could be used in the present invention.

Referring again to the second and fourth embodiments of the present invention, the cutter (220,420) may advance at a faster rate than the extended material end (255,455) itself. Therefore, it might interfere with the hand of the user during the early stages of dispensing. If this happens, the linkage will automatically balance the forces, allowing a short length of material to advance. In practice, this happens without the user taking much notice.

A dispenser roller on which a material of indeterminate length is engaged has been disclosed. Five embodiments of the present invention have been described in detail. General considerations about how best to configure and operate the present invention have been disclosed. The special case of using the present invention to dispense adhesive tape has been described by way of example, rather than by limitation. It is clear that the present invention is equally applicable for the improved dispensing of ribbon, film, sheet foil, wrapping paper and the like, as well as string, wire, hose, and the like. Therefore, the invention presently disclosed which dispenses these and other materials of indeterminate length is deemed to be within the spirit and scope of the following claims.

What is claimed is:

1. A manually powered tape dispenser for dispensing segments of tape of the type which has adhesive on at least one side, which dispenser comprises:

a. a first roller, which is rotatably supported, the first roller having rotation limited between an initial angle and a cutting angle, the first roller having a feeding rotation direction when the first roller rotates away from the initial angle, and having a reversing rotation direction which is opposite the feeding rotation direction;

b. a second roller, which is rotatably supported, the second roller having a surface on which an extended tape end may be adhered in a cantilever manner;

c. a means of slipping frictional contact between the first roller and the second roller, wherein if the first roller were to be stopped from rotating, and if a first pulling force which is less than a drag force were to be exerted on the extended tape end, then the second roller would not rotate, and wherein if the first roller were to be stopped from rotating, and if a second pulling force which is equal to or greater than the drag force were to be exerted on the extended tape end, then the second roller would rotate;

d. a stored energy means, wherein energy of the stored energy means increases when the first roller rotates in the feeding rotation direction, the stored energy means providing a bias torque urging the first roller to rotate in the reversing rotation direction, wherein the bias torque creates a bias force at the surface of the second roller, wherein the bias force is less than the drag force at every first roller angle;

e. a cutter, having a sharp edge;

whereby it necessarily follows, if the first pulling force were to be exerted on the extended tape end, then the second roller would rotate in unison with the first roller away from the initial angle in the feeding rotation direction; and whereby thereafter if the first roller were to be at the cutting angle, then the second pulling force exerted on the extended tape end would cause the second roller to rotate relative to the first roller, thereby advancing an additional length of tape; and whereby thereafter if the additional length of tape were to be manually forced against the sharp edge, then the tape would sever; and whereby thereafter if the tape were to be severed, then the stored energy means would cause the first roller and the second roller to rotate in unison in the reversing rotation direction;

wherein thereafter a cut edge of a new extended tape end would move away from the sharp edge.

2. The dispenser of claim 1, wherein said cutter is fixed.

3. The dispenser of claim 2, which additionally comprises a means of support for a roll of tape.

4. The dispenser of claim 2, wherein said surface of said second roller comprises a cambered surface for disposing the extended tape end in a straight shape.

5. The dispenser of claim 2, wherein said stored energy means comprises a spring.

6. The dispenser of claim 2, wherein said stored energy means comprises an unbalanced weight.

7. A manually powered tape dispenser for dispensing segments of tape of the type which has adhesive on at least one side, which dispenser comprises:

a. a first roller, which is rotatably supported, the first roller having rotation limited between an initial angle and a cutting angle, the first roller having a feeding rotation direction when the first roller rotates away from the initial angle, and having a reversing rotation direction which is opposite the feeding rotation direction;

b. a second roller, which is rotatably supported, the second roller having a surface on which an extended tape end may be adhered in a cantilever manner;

c. a means of slipping frictional contact between the first roller and the second roller, wherein if the first roller were to be stopped from rotating, and if a first pulling force which is less than a drag force were to be exerted on the extended tape end, then the second roller would not rotate, and wherein if the first roller were to be stopped from rotating, and if a second pulling force which is equal to or greater than the drag force were to be exerted on the extended tape end, then the second roller would rotate;

d. a stored energy means, wherein energy of the stored energy means increases when the first roller rotates in the feeding rotation direction, the stored energy means providing a bias torque urging the first roller to rotate in the reversing rotation direction, wherein the bias torque creates a bias force at the surface of the second roller, wherein the bias force is less than the drag force at every first roller angle;

e. a cutter, which is movably supported between a start position and a severing position, the cutter having a sharp edge;

f. a means of powering the cutter, wherein if the first roller rotates, then the means of powering causes the cutter to move, and wherein if the first roller stops, then the means of powering causes the cutter to stop, and wherein if the first roller is at the initial angle, then the cutter is at the start position, and wherein if the first roller is at the cutting angle, then the cutter is at the severing position;

whereby it necessarily follows, if the first pulling force were to be exerted on the extended tape end, then the second roller would rotate in unison with the first roller away from the initial angle in the feeding rotation direction and the cutter would move away from the start position; and whereby thereafter if the first roller were to be at the cutting angle and the cutter were to be at the severing position, then the second pulling force exerted on the extended tape end would cause the second roller to rotate relative to the first roller, thereby advancing an additional length of tape; and whereby thereafter if the additional length of tape were to be manually forced against the sharp edge, then the tape would sever; and whereby thereafter if the tape were to be severed, then the stored energy means would cause the first roller and the second roller to rotate in unison in the reversing rotation direction;

wherein thereafter a distance between a cut edge of a new extended tape end and the sharp edge would increase.

8. The dispenser of claim 7, which additionally comprises a means of support for a roll of tape.

9. The dispenser of claim 7, wherein said surface of said second roller comprises a cambered surface for disposing the extended tape in a straight shape.

10. The dispenser of claim 7, wherein said stored energy means comprises a spring.

11. The dispenser of claim 7, wherein said stored energy means comprises an unbalanced weight.

12. The dispenser of claim 7, wherein said first roller comprises an arm, and wherein said means of powering comprises a link, which is pivotably connected at a first end to the arm, and which is pivotably connected at a second end to the cutter.

13. A manually powered tape dispenser for dispensing segments of tape of the type which has adhesive on at least one side, which dispenser comprises:

a. primary roller, which is rotatably supported about an axle, wherein said axle is fixed;

b. a secondary roller, which is rotatably supported, the secondary roller having a surface on which an extended tape end may be adhered in a cantilever manner, the secondary roller having rotation relative to the primary roller limited between an initial angle and a cutting angle, the secondary roller having a feeding rotation direction when the secondary roller rotates away from the initial angle, and having a reversing rotation direction which is opposite the feeding rotation direction;

c. a means of slipping frictional contact between the primary roller and the axle, wherein if the secondary roller were to be stopped from rotating relative to the primary roller, and if a first pulling force which is less than a drag force were to be exerted on the extended tape end, then the primary roller would not rotate relative to the axle, and wherein if the secondary roller were to be stopped from rotating relative to the primary roller, and if a second pulling force which is equal to or greater than the drag force were to be exerted on the extended tape end, then the primary roller would rotate relative to the axle;

d. a stored energy means, wherein energy of the stored energy means increases when the secondary roller rotates in the feeding rotation direction relative to the primary roller, the stored energy means providing a bias torque urging the secondary roller to rotate in the reversing rotation direction relative to the primary roller, wherein the bias torque creates a bias force at the surface of the secondary roller, wherein the bias force is less than the drag force at every secondary roller angle;

e. a cutter, having a sharp edge;

whereby it necessarily follows, if the first pulling force were to be exerted on the extended tape end, then the secondary roller would rotate away from the initial angle in the feeding rotation direction; and whereby thereafter if the secondary roller were to be at the cutting angle, then the second pulling force exerted on the extended tape end would cause the secondary roller and the primary roller to rotate in unison relative to the axle, thereby advancing an additional length of tape; and whereby thereafter if the additional length of tape were to be manually forced against the sharp edge, then the tape would sever; and whereby thereafter if the tape were to be severed, then the stored energy means would cause the secondary roller to rotate in the reversing rotation direction; wherein thereafter a cut edge of a new extended tape end would move away from the sharp edge.

14. The dispenser of claim 13, wherein said surface of said secondary roller comprises a cambered surface for disposing the extended tape end in a straight shape.

* * * * *